US011945632B2

(12) United States Patent
Ellis et al.

(10) Patent No.: US 11,945,632 B2
(45) Date of Patent: Apr. 2, 2024

(54) CONTACT LENS PACKAGES AND METHODS OF USE

(71) Applicant: CooperVision International Limited, Fareham (GB)

(72) Inventors: Matthew John Ellis, Romsey (GB); Timothy Noyce, Waterlooville (GB); Dmitrijus Sluka, Southampton (GB)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 18/131,881

(22) Filed: Apr. 7, 2023

(65) Prior Publication Data

US 2023/0242317 A1 Aug. 3, 2023

Related U.S. Application Data

(63) Continuation of application No. 17/336,361, filed on Jun. 2, 2021, now Pat. No. 11,649,099.

(60) Provisional application No. 63/042,575, filed on Jun. 23, 2020.

(51) Int. Cl.
*B65D 75/32* (2006.01)

(52) U.S. Cl.
CPC .... *B65D 75/326* (2013.01); *B65D 2575/3245* (2013.01); *B65D 2585/545* (2013.01)

(58) Field of Classification Search
CPC ..... B65D 2585/545; B65D 2585/54; B65D 75/325; B65D 75/326
USPC ..... 206/5, 5.1, 467, 210
See application file for complete search history.

(56) References Cited

U.S. PATENT DOCUMENTS

| | | | | |
|---|---|---|---|---|
| 4,691,820 | A | 9/1987 | Martinez | |
| 5,054,610 | A | 10/1991 | Ajello | |
| 5,337,888 | A | 8/1994 | Morrison | |
| 5,375,698 | A | 12/1994 | Ewart et al. | |
| 5,409,104 | A | 4/1995 | Lovell | |
| 5,467,868 | A | 11/1995 | Abrams et al. | |
| 5,515,964 | A * | 5/1996 | Bauman | A45C 11/005 206/210 |
| 5,573,108 | A | 11/1996 | Hamilton et al. | |

(Continued)

FOREIGN PATENT DOCUMENTS

| | | | |
|---|---|---|---|
| CN | 1406836 | A | 4/2003 |
| CN | 201169427 | Y | 12/2008 |

(Continued)

OTHER PUBLICATIONS

Office Action issued in corresponding Taiwan Patent Application No. 110121825 dated Aug. 17, 2022 (with English translation) (12 pages).

(Continued)

*Primary Examiner* — Chun Hoi Cheung
(74) *Attorney, Agent, or Firm* — Kilyk & Bowersox, P.L.L.C.

(57) ABSTRACT

A blister package for a contact lens includes a base sheet and a sealing sheet. Either the base sheet or the sealing sheet includes a bowl, and the other sheet includes a dome and a sealing surface. The dome has a radius of curvature of about 13 mm to 19 mm and a height of less than 7 mm relative to the sealing surface. The dome is configured to protrude into the bowl to form a cavity. Related methods are also described.

14 Claims, 3 Drawing Sheets

(56) References Cited

U.S. PATENT DOCUMENTS

| | | | | |
|---|---|---|---|---|
| 5,609,246 | A | 3/1997 | Borghorst et al. | |
| 5,620,088 | A | 4/1997 | Martin et al. | |
| 5,695,049 | A | 12/1997 | Bauman | |
| 5,697,495 | A | 12/1997 | Abrams et al. | |
| 5,704,468 | A | 1/1998 | Lust et al. | |
| 5,711,416 | A | 1/1998 | Bauman | |
| 5,722,536 | A | 3/1998 | Pierce et al. | |
| 5,823,327 | A | 10/1998 | Wu et al. | |
| 5,983,608 | A | 11/1999 | Wu et al. | |
| 6,029,808 | A | 2/2000 | Peck et al. | |
| 6,044,966 | A | 4/2000 | Haase | |
| 6,401,915 | B1 * | 6/2002 | Faxe | B65D 75/32 294/1.2 |
| 6,889,825 | B2 * | 5/2005 | Ichikawa | B65D 77/2036 220/359.1 |
| 7,275,275 | B2 * | 10/2007 | Pankow | G02C 13/008 15/104.93 |
| 7,850,002 | B2 * | 12/2010 | Newman | B65D 81/05 206/5.1 |
| 10,901,236 | B2 | 1/2021 | Schweizer et al. | |
| 2002/0046958 | A1 | 4/2002 | Lipscomb et al. | |
| 2003/0029736 | A1 | 2/2003 | Phillips et al. | |
| 2004/0238380 | A1 * | 12/2004 | Newman | B65D 81/22 206/5.1 |
| 2006/0219577 | A1 | 10/2006 | Newman | |
| 2014/0246337 | A1 | 9/2014 | Newman | |
| 2015/0129437 | A1 * | 5/2015 | Clamp | B65D 81/22 53/445 |
| 2020/0229563 | A1 * | 7/2020 | Almond | B65D 75/366 |
| 2021/0315118 | A1 | 10/2021 | Shimizu et al. | |
| 2021/0394986 | A1 | 12/2021 | Ellis et al. | |

FOREIGN PATENT DOCUMENTS

| | | | |
|---|---|---|---|
| CN | 101516739 | A | 8/2009 |
| JP | 10313928 | A | 12/1998 |
| JP | 2006016049 | A | 1/2006 |
| JP | 2012110592 | A | 6/2012 |
| JP | 2014218255 | A | 11/2014 |
| JP | 2017178352 | A | 10/2017 |
| KR | 1020090060075 | A | 6/2009 |
| TW | 201321280 | A | 6/2013 |
| WO | 2009069264 | A1 | 6/2009 |
| WO | 2012168964 | A1 | 12/2012 |
| WO | 2013098870 | A1 | 4/2013 |
| WO | 2013153582 | A1 | 10/2013 |

OTHER PUBLICATIONS

Search and Examination Report issued in corresponding United Kingdom Patent Application No. GB2108803.4 dated Nov. 29, 2021 (8 pages).

Office Action issued in corresponding Chinese Patent Application 202180043985.4 dated Aug. 10, 2023 (with English translation) (13 pages).

Office Action issued in corresponding Korean Patent Application No. 10-2023-7001977 dated Oct. 18, 2023 (with English translation) (12 pages).

International Search Report and Written Opinion issued in corresponding International Patent Application No. PCT/GB2021/051560 dated Aug. 17, 2021 (16 pages).

* cited by examiner

CONTACT LENS PACKAGES AND METHODS OF USE

This application is a continuation of U.S. patent application Ser. No. 17/336,361 filed Jun. 2, 2021, which in turn claims the benefit under 35 U.S.C. § 119(e) of prior U.S. Provisional Patent Application No. 63/042,575, filed Jun. 23, 2020, which is incorporated in its entirety by reference herein.

The present disclosure relates to contact lens packaging and methods of use and, more specifically, to blister packages and methods of using blister packages containing a contact lens.

FIELD

Background

Contact lenses such as hydrogel and silicone hydrogel contact lenses are frequently packaged in sealed blister packages or blister packs that permit storage of the unworn contact lens in a sterile environment. For instance, a blister package which is adapted to provide a sterile sealed storage environment for a disposable hydrophilic contact lens is described in U.S. Pat. No. 4,691,820. Further examples of contact lens packages are disclosed in U.S. Pat. Nos. 5,054,610; 5,337,888; 5,375,698; 5,409,104; 5,467,868; 5,515,964; 5,609,246; 5,620,088; 5,695,049; 5,697,495; 5,704,468; 5,711,416; 5,722,536; 5,573,108; 5,823,327; 5,704,468; 5,983,608; 6,029,808; 6,044,966; and 6,401,915.

Many contact lens packages consist of a relatively rigid thermoplastic base having a bowl to store a contact lens in a packaging solution, and a pliable sealing member sealed to the thermoplastic base. Contact lens packages typically require a user to peel the pliable sealing member from the thermoplastic base and place a finger in a cavity or bowl to pinch or otherwise manipulate the contact lens so that it can be removed from the package. The contact lens then needs to be positioned on a fingertip, so that it can be placed on an eye. Handling the contact lens can introduce contaminants to the surface of the lens which are then transferred to the eye.

There remains a need to improve contact lens packaging, which, among other things is convenient for a user and minimises the need for touching the contact lens, or at least minimises the need to touch the concave surface of the contact lens before it is placed on an eye.

SUMMARY

The present disclosure addresses this need. In a first aspect, the present disclosure provides a blister package having the features as described herein.

The inventors have found that the concave surface of a contact lens stored within the cavity formed between the dome and the bowl of the present contact lens packages surprisingly adheres to the dome. Thus, as the sealing sheet is peeled away from the base sheet, the contact lens is lifted out of the bowl with the convex surface of the contact lens presented towards the user and the concave surface adhered to the dome.

The present disclosure further provides a method for removing a contact lens from a blister package, the method having the features as described herein. The contact lens can thus be removed from the dome and placed on the surface of an eye.

Preferred but optional features are set out as well.

Additional aspects and embodiments of the blister package and methods will be apparent from the following description, drawings, and claims. As can be appreciated from the foregoing and following description, each and every feature described herein, and each and every combination of two or more of such features, is included within the scope of the present disclosure provided that the features included in such a combination are not mutually inconsistent. In addition, any feature or combination of features may be specifically excluded from any embodiment.

BRIEF DESCRIPTION OF THE DRAWINGS

Embodiments of the present disclosure will now be described, by way of example only, with reference to the accompanying drawings.

DETAILED DESCRIPTION

Figure 1:
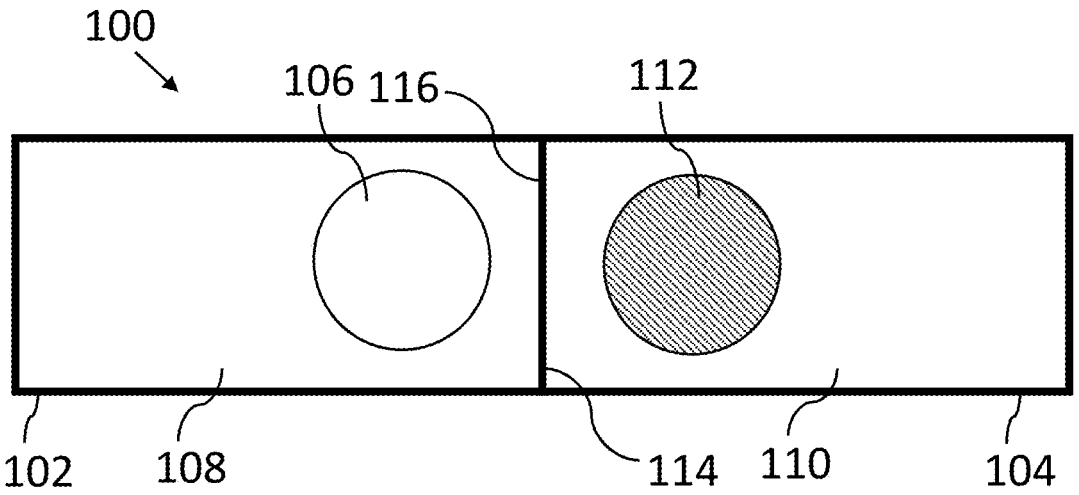
FIG. 1 shows a top view of an example of a blister package according to the present disclosure.

A contact lens blister package has been developed that facilitates the removal of a contact lens stored within the blister package. In particular, the blister package enables a user to avoid touching the concave surface of the contact lens prior to placing on an eye and to remove the contact lens from the package without needing to place a finger into a cavity or bowl to pinch or otherwise manipulate the contact lens. In addition, the blister package reduces the likelihood of the contact lens turning inside out when stored in the blister package. These advantages help to reduce the likelihood of contaminating the contact lens prior to placing on an eye, which may result in ocular discomfort, irritation or infection.

As set out above, the first aspect of the present disclosure provides a blister package for a contact lens. The blister package comprises a base sheet and a sealing sheet. One of the base sheet and the sealing sheet includes a bowl; the other of the base sheet and the sealing sheet includes a dome configured to conform with a concave surface of a contact lens. The dome protrudes into the bowl and thereby forms a cavity between the dome and the bowl. The base sheet and the sealing sheet are releasably attached to each other, thereby releasably sealing the cavity. However, the base sheet and the sealing sheet are coupled together to have a seal suitable for withstanding autoclaving of the sealed package containing the contact lens. The base sheet may include a flange portion extending outwardly from the periphery of the bowl. The flange portion may have a top and bottom surface. The sealing sheet may include a sealing surface and the dome may protrude from the sealing surface.

The sealing sheet may include a pull-tab positioned near or at an outer edge of the sealing sheet. The pull-tab may be in the form of a flap that can be gripped by a user.

The sealing sheet may be attached to the top surface of the flange portion.

The sealing surface may be reversibly attached about the periphery of the bowl.

The sealing surface may be reversibly attached about the entire periphery of the bowl. The cavity formed between the dome and bowl may be hermetically sealed.

The bowl is configured to hold a contact lens and a volume of contact lens packaging solution. The cavity is formed between the dome and an inner surface of the bowl. The bowl may have a substantially rounded, cylindrical, concave or frusto-conical shape.

Typically, the bowl has a radius of curvature of about 8 mm to 14 mm and a depth of less than 10 mm relative to the top surface of the periphery of the bowl, preferably a depth of less than 10 mm and more than 4 mm. It has been determined that a bowl having a radius of curvature of about 8 mm to about 14 mm and a depth of less than 10 mm relative to the top surface of the periphery of the bowl is particularly effective at holding a contact lens in a position that allows the contact lens to adhere to the dome. A radius of curvature of about 10 mm to about 12 mm and a depth of about 6 mm to about 8 mm relative to the periphery of the bowl has been found to be particularly advantageous, for example a radius of curvature of about 11 mm and a depth of about 7 mm relative to the periphery of the bowl.

The dome is configured to substantially conform to a surface of a contact lens. For example, the dome may have a convex surface that substantially conforms to the concave surface of a contact lens.

Typically, the dome has a radius of curvature of 13 mm to 19 mm and a height of less than 7 mm relative to the sealing surface, preferably a height of less than 7 mm and more than 1 mm. It has been determined that a contact lens will readily adhere to a dome having a radius of curvature of about 13 mm to about 19 mm and a height of less than 7 mm relative to the sealing surface. In particular, a radius of curvature of 14.0 mm to 18.0 mm and height of 3.5 mm to 4.5 mm has been found to be particularly effective, for example a radius of curvature of about 15.7 mm and height of about 4 mm relative to the sealing surface.

Typically, the bowl has a radius of curvature that is less than the radius of curvature of the dome and a depth that is greater than the height of the dome. Thus, the dome is shallower and less curved than the bowl. Typically, the radius of curvature of the bowl is at least 5% (for example, at least about 10%, 20%, 30%, 40%, 50%, 60%, 70%, 80%, 90% or 100%) less than the radius of curvature of the dome and the depth of the bowl is at least 5% (for example, at least about 10%, 20%, 30%, 40%, 50%, 60%, 70%, 80%, 90% or 100%) greater than the height of the dome. It has been found that a contact lens can be reliably lifted out of the bowl when the dome is shallower and less curved than the bowl. It is particularly effective for the bowl to have a radius of curvature that is about 20% to about 40% less than the radius of curvature of the dome and a depth that is about 30% to about 50% greater than the height of the dome. Preferably, the bowl has a radius of curvature that is about 25% to about 35% less than the radius of curvature of the dome and a depth that is about 35% to about 45% greater than the height of the dome, for example, the bowl may have a radius of curvature of about 11 mm and depth of about 7 mm, and the dome may have a radius of curvature of about 15.7 mm and height of about 4 mm.

The cavity formed between the dome and bowl has a volume suitable for containing a contact lens and a volume of contact lens packaging solution. For example, the cavity can have a volume of 2.0 mL or less, for example about 1.5 mL to about 2.0 mL, 1.0 mL to 1.5 mL, 0.5 mL to 1.0 mL or 0.1 mL to 0.5 mL. Preferably, the cavity has a volume of 0.3 mL to 0.9 mL (for example, 0.3 mL, 0.4 mL, 0.5 mL, 0.6 mL, 0.7 mL, 0.8 mL and 0.9 mL). More preferably, the cavity has volume of 0.4 mL to 0.8 mL (for example 0.40 mL, 0.45 mL, 0.50 mL, 0.55 mL, 0.60 mL, 0.65 mL, 0.70 mL, 0.75 mL and 0.80 mL). Even more preferably, the cavity has volume of 0.5 mL to 0.7 mL (for example, 0.50 mL, 0.51 mL, 0.52 mL, 0.53 mL, 0.54 mL, 0.55 mL, 0.56 mL, 0.57 mL, 0.58 mL, 0.59 mL, 0.60 mL, 0.61 mL, 0.62 mL, 0.63 mL, 0.64 mL, 0.65 mL, 0.66 mL, 0.67 mL, 0.68 mL, 0.69 mL and 0.70 mL).

The volume of the packaging solution in the bowl will be less than the volume of the cavity. For example, the volume of the packaging solution may be from 0.3 mL to 0.7 mL. The amount of the packaging solution should be sufficient to store the contact lens in a hydrated state without resulting in unwanted physical distortion of the contact lens. Preferably, the amount of the packaging solution in the bowl is from 0.4 mL to 0.6 mL.

The base sheet, the sealing sheet, or both may include a transition surface extending from the planar surface to the curved surface of the bowl or the dome. The transition surface may be planar and provide a descent angle from the planar surface of the base sheet or sealing sheet to the curved surface of the bowl or the dome (i.e. the concave surface of the bowl or the convex surface of the dome). Or, the transition surface may be curved and have a radius of curvature that facilitates the separation of the sealing sheet from the base sheet using a desired amount of force. Preferably, the transition surface is convexly curved from the planar surface of the base sheet to the concave surface of the bowl, and the radius of curvature of the transition surface is at least 0.4 mm. For example, the radius of curvature of the transition surface may be from 0.4 mm to 5.0 mm. Or, the radius of curvature of the transition surface may be from 0.5 mm to 4.0 mm. Or, the radius of curvature of the transition surface may be from 0.5 mm to 3.0 mm. The inventors have found that the transition surface described herein may make it easier to open the blister package described herein. In addition, or alternatively, it appears that increasing the radius of curvature of the transition surface may reduce defects in the blister package that occur after autoclaving the sealed blister package. For example, it has been observed that in some blister packages having a transition surface with a radius of curvature of about 0.5 mm, delamination may occur between the laminated layers of the base sheet or between the laminated layers of the sealing sheet, or both. By providing a radius of curvature that is greater than 0.5 mm for the transition surface, for example, by providing a radius of curvature from 1.0 mm to 5.0 mm for the transition surface, the number of autoclaved sealed blister packages that exhibit delamination in the base sheet, the sealing sheet, or both can be reduced.

The sealing sheet and base sheet may be separate or may be partially attached near or at an outer edge of the base or sealing sheet.

A contact lens may be sealed within the cavity formed between the dome and bowl. A contact lens packaging solution may be sealed within the cavity formed between the dome and bowl. For example, the sealing surface may be attached about the periphery of the bowl, thus sealing the contact lens and contact lens packaging solution within the package. The contact lens and the contact lens packaging solution may be hermetically sealed within the cavity such that the packaging can withstand sterilization under autoclave without rupturing. Preferably, the contact lens sealed within the cavity is an unworn contact lens.

A typical contact lens, suitable for inclusion in the cavity, has a generally convex surface and an opposing generally concave surface; the convex surface faces away from the eye when the contact lens is located on an eye, and the concave surface is oriented towards the eye when the contact lens is located on an eye. The contact lens is substantially a spherical cap in shape and has a diameter of about 4 mm to about 20 mm. For example, the contact lens may have a diameter of 5 mm to 17 mm, 6 mm to 16 mm or 7 mm to 15 mm. The contact lens also has a base curve of about 6 mm to about 15 mm. For example, the contact lens may have a base curve of 7 mm to 14 mm, 7 mm to 13 mm, 7 mm to 12 mm, 7 mm to 11 mm, 7 mm to 10 mm or 7 mm to 9 mm. Preferably, the contact lens has a diameter of about 13 mm to about 15 mm (for example, 14.0 mm, 14.2 mm or 14.4 mm) and a base curve of about 8 mm to about 9 mm (for example, 8.4 mm, 8.6 mm, and 8.7 mm).

The contact lens sealed within the cavity may be orientated with its concave surface facing towards the dome. Preferably, the concave surface of the contact lens is reversibly adhered to the dome.

Examples of contact lenses that may be stored in the blister package include hydrogel contact lens or silicone hydrogel contact lens. Specific examples include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, fanfilcon A, etafilcon A, senofilcon A, senofilcon B, senofilcon C, narafilcon A, narafilcon B, balafilcon A, samfilcon A, kalifilcon A, lotrafilcon A, lotrafilcon B, somofilcon A, riofilcon A, delefilcon A, verofilcon A, and the like.

The contact lens packaging solution contained within the cavity can be any known liquid or solution useful for storing contact lenses, including water, saline solutions, or buffered aqueous solutions. The contact lens and contact lens packaging solution preferably fill at least 40 percent, at least 50 percent, at least 60 percent, at least 70 percent, at least 80 percent or at least 90 percent, of the total volume of the cavity formed between the bowl and the dome. The contact lens and contact lens packaging solution preferably fill at least 60 percent of the total volume of the cavity formed between the bowl and the dome. For example, the contact lens and contact lens packaging solution may fill 60, 65, 70, 75, 80, 85, 90 or 95 percent or more (for example, 95, 96, 97, 98, 99 or 100 percent) of the total volume of the cavity formed between the bowl and the dome, and more preferably, at least 70 percent of the total volume of the cavity formed between the bowl and the dome.

The solution is typically a phosphate buffered saline solution or a borate buffered saline solution, which can contain one or more additives, such as surfactants, wetting agents, viscosity agents, and the like.

The blister package may be about 30 mm to 35 mm wide, about 60 mm to 70 mm long and about 10 mm high. It should be appreciated, however, that the blister package can have any size and/or shape.

The base sheet of the blister package may comprise a foil material, the sealing sheet may comprise a foil material, or both the base sheet and sealing sheet may comprise a foil material. The foil material may comprise a metal foil material, such as aluminum foil. The base sheet and/or the sealing sheet may comprise a two-layer or multi-layer material, for example, the base sheet and/or the sealing sheet may comprise a plastic laminated foil material, such as a polypropylene laminated metal foil material or a polyamide laminated metal foil. The dome may be reinforced with a layer of plastic material, a double layer of foil, a plastic reinforcing dome, a combination thereof, or the like. The bowl may be reinforced with a layer of plastic material, a double layer of foil, a plastic reinforcing dome, a combination thereof, or the like. The bowl and/or dome may have a preformed adhesive ring around the periphery of the bowl and/or dome. The base sheet may comprise a plastic material and the sealing sheet may comprise a foil material. The base sheet and sealing sheet may be a monolithic structure formed of the same material. The base sheet and the sealing sheet may be adhered together by applying heat and pressure to join the two sheets together using a heat sealing machine. Suitable foil materials useful for the base sheet, or the sealing sheet, or both can be obtained from companies, such as Amcor Flexibles in Europe or North America (www.amcor.com).

Examples of blister package materials and methods of making blister packages, are described, for example, in U.S. Pat. Nos. 6,398,018, 7,426,993 B2, and 7,477,366 B2, in U.S. Patent Application Publications Nos. US 2012/0061260 Al, and US 2017/0096272 Al, and in WO 2013/160667, each of which is incorporated herein by reference. Those skilled in the art will be familiar with suitable materials and techniques known in the art for manufacturing blister packages.

The present blister packages may have a dome that has a radius of curvature from 14 mm to 18 mm, and a bowl that has a radius of curvature from 9 mm to 13 mm, and the base sheet has a transition surface extending radially outward from the bowl, the transition surface having a convex surface having a radius of curvature from 0.4 mm to 5.0 mm. A hydrogel or silicone hydrogel contact lens may be included in a packaging solution contained in a cavity between the concave surface of the bowl and the convex surface of the dome. The hydrogel or silicone hydrogel contact lens may have a diameter from 13.0 mm to 15.00 mm and a base curve from 8.0 mm to 9.0 mm. The hydrogel or silicone hydrogel may have an external sagittal height from 3.5 mm to 4.5 mm. (The external sagittal height corresponds to the perpendicular distance from the convex surface at the geometric center of the contact lens to the closest point of the plane containing the entire contact lens edge). Each of the base sheet and the sealing sheet may comprise, consist essentially of, or consist of a laminated foil, as described above.

The present blister packages may be attached together to form an array of blister packages. They may be attached laterally at their sides, or they may be stacked upon each other.

As set out above, a second aspect of this disclosure provides a method of removing a contact lens from a blister package of the first aspect, wherein the blister package contains a contact lens and a contact lens packaging solution, both sealed within the cavity formed between the dome and the bowl. Preferably, the contact lens is reversibly adhered to the dome.

The method comprises a step of peeling the sealing sheet away from the base sheet such that the dome and the contact lens are pulled away from the bowl.

The sealing sheet can be pulled away from the base by first pulling an edge of the sealing sheet away from the base sheet followed by peeling the remaining attached portion of the sealing sheet away from the base sheet. For example, the method can involve a user holding the base sheet between a thumb and a finger of a first hand, and then gripping the top member with a thumb and finger of a second hand before pulling the sealing sheet away from the base sheet.

The sealing sheet may be pulled entirely away from the base sheet such that the sealing surface is no longer attached to the base sheet. Alternatively, the sealing sheet may be partially pulled away from the base sheet so that the dome and bowl are accessible to a user, but the sealing sheet remains attached to the base sheet. For example, the sealing sheet can be pulled away from the base sheet such that the sealing surface is completely detached from the periphery of the bowl but remains attached near or at an outer edge of the flange portion.

Preferably, the contact lens is reversibly adhered to the dome. Thus, as the sealing sheet is pulled away from the base sheet, the contact lens is lifted out of the bowl. More preferably, the concave surface of the contact lens is reversibly adhered to the dome. The convex surface of the contact lens is therefore presented to a user and the concave surface is reversibly adhered to the dome.

The blister package may comprise a sealing member having a pull-tab. The pull-tab can be pulled to separate the sealing sheet from the base sheet. Thus, the method may further comprise peeling the sealing sheet away from the base sheet by pulling the pull-tab. For example, a user can hold the base sheet between a thumb and a finger of a first hand, and then grip the pull-tab with a thumb and finger of a second hand before pulling the pull-tab and the sealing sheet away from the base sheet.

The method may comprise positioning the blister package such that the contact lens packaging solution is substantially contained within the bowl as the sealing sheet is peeled away from the base sheet; that is to say, that the blister package is held by a user such that the bowl is directed upwards, away from the floor and the contact lens packaging solution substantially sits within the bowl as the sealing sheet is peeled away from the base sheet.

The present method may further comprise removing the contact lens from the dome after the sealing sheet has been pulled away from the base sheet. The contact lens can then be placed on the surface of an eye, for example a human eye.

The method may further comprise pouring the contact lens packaging solution out of the bowl and/or disposing of the blister package.

As explained above, the present inventors have found that a contact lens contained within the cavity formed between the bowl and dome of the blister package surprisingly adheres to the dome that defines the cavity. Thus, as the sealing sheet and the base sheet are peeled apart, the contact lens is lifted out of the bowl. Advantageously, the concave surface of the contact lens reversibly adheres to the dome. Thus, as the contact lens is lifted out of the bowl, it is presented to a user with the convex surface of the contact lens presented towards the user and the concave surface adhered to the dome. The contact lens is therefore presented in an orientation that allows the user to avoid touching the inner concave surface of the lens to remove the lens from the blister package and position the contact lens for transferring to the surface of an eye. Furthermore, the blister package and methods enable a user to remove a contact lens from the blister package without contacting the packaging solution contained within the bowl.

With reference to the drawing figures, FIG. 1 shows a top view of an example blister package 100 according to the present disclosure before a contact lens and contact lens packaging solution are sealed within the package. The package has a foil base sheet 102 and a foil sealing sheet 104. The base sheet 102 has a bowl 106 and a flange portion 108 that extends outwardly away from the periphery of the bowl 106. Bowl 106 is recessed (in the drawing of FIG. 1, into the page) from flange portion 108. The sealing sheet 104 has a dome 112 and a flange portion including a sealing surface 110. The dome 112 extends (in the drawing of FIG. 1, out of the page) from the sealing surface 110. Outer edge 114 of the sealing sheet 104 is attached along outer edge 116 of the base sheet 102. A contact lens and contact lens packaging solution can be contained within bowl 106. The sealing sheet can be folded along a hinge formed by the attached outer edges 116 and 114 such that the sealing surface 110 covers the flange portion 108. In such a configuration, the dome 112 extends into the bowl 106 to form a cavity between the generally convex surface of the dome 112 and the generally concave surface of the bowl 106.

Figure 2:
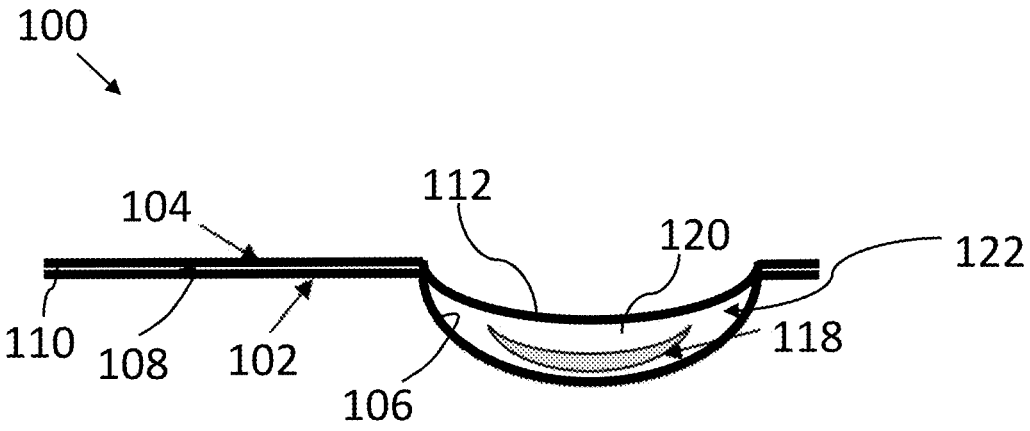
FIG. 2 shows a side view of the blister package of FIG. 1 containing a contact lens and a contact lens packaging solution sealed within the cavity formed between the bowl and dome.

FIG. 2 shows the blister package 100 in a sealed configuration with a contact lens 118 and contact lens packaging solution 120 sealed within the blister package. The sealing sheet 104 is superposed onto the base sheet 102. The dome 112 is aligned with the bowl 106 such that the dome 112 extends into the bowl 106. The sealing surface 110 is attached about the periphery of the bowl 106 to form a sealed cavity 122 between the bowl 106 and the dome 112. A contact lens 118 and contact lens packaging solution 120 are sealed within the cavity 122. The dome 112 conforms or substantially conforms to the concave surface of contact lens 118. The contact lens 102 is orientated with its concave surface facing towards the convex surface of the dome 112.

Figure 3:
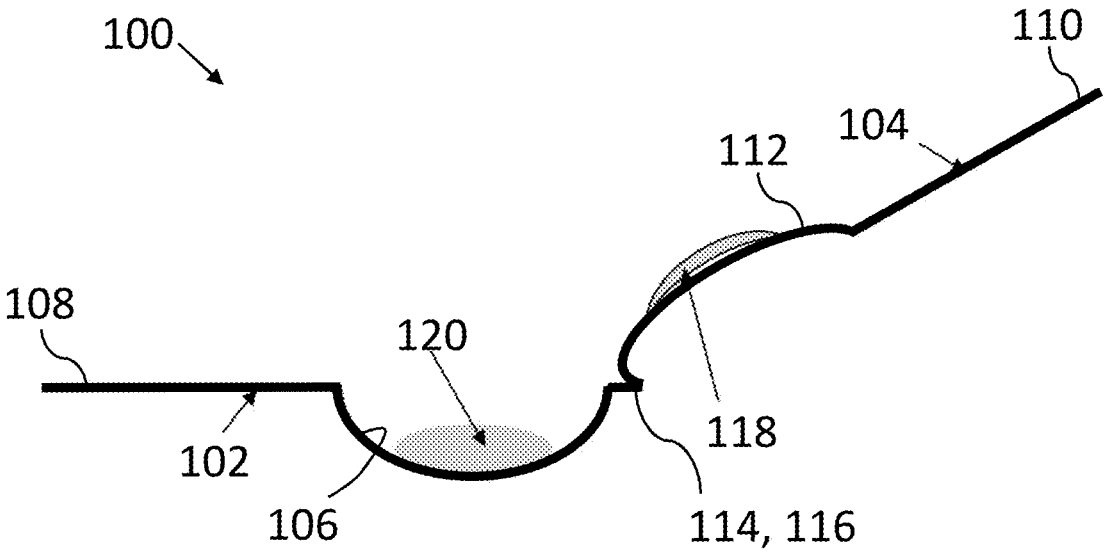
FIG. 3 shows a side view of the blister package of FIG. 1 after the sealing sheet has been pulled away from the base sheet.

FIG. 3 shows a side view of blister package 100 with the sealing sheet 104 peeled away from the base sheet 102. The sealing surface 110 is detached from the periphery of the bowl such that the bowl and the dome are accessible to a user. The concave surface of contact lens 118 is adhered to the dome 112. Thus, the convex surface of contact lens 118 is presented to a user. The contact lens packaging solution 120 is substantially contained within the bowl 106. A user can remove contact lens 118 from dome 112 without touching the concave surface of the contact lens and without touching the contact lens packaging solution contained within the bowl 106. The base sheet and sealing sheet remain attached along outer edges 114 and 116.

Figure 4:
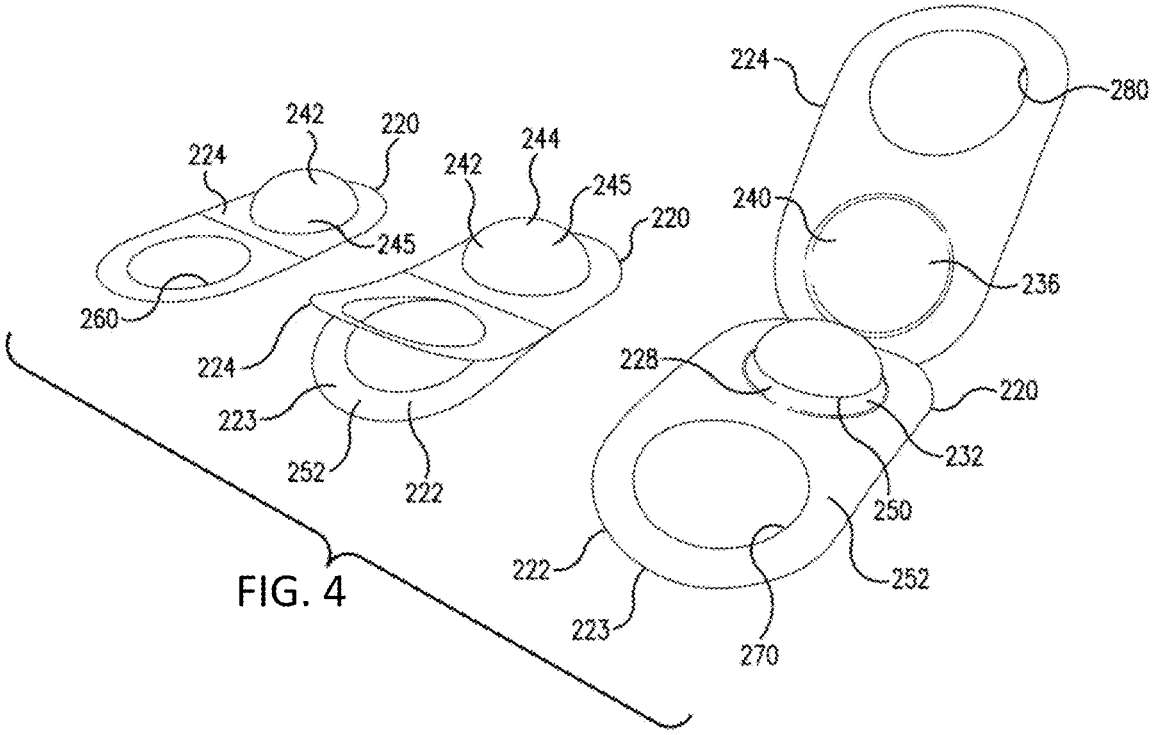
FIG. 4 shows a series of steps involved with opening a blister package according to a particular embodiment of the present disclosure.

FIG. 4 shows a blister package 220, which is configured such that when it is opened, the contact lens 250 is presented to the user on a dome 228, which acts as a seat for the contact lens (as shown by the far right image in FIG. 4). The contact lens can be lifted from the dome without the need to dig into the bowl, which may contain a contact lens packaging solution, to retrieve the contact lens. For the contact lens to be presented on the dome, the blister package 220 must be positioned such that the dome 228 is directed upwards, away from the floor, when the bowl 236 is lifted away from the dome 228. FIG. 4 shows the blister package 220 at three different points in time during the opening procedure. To the far left is a new, unopened, and unpeeled blister package 220. Blister package 220 comprises a base sheet 224 and a sealing sheet 222 sealing a contact lens 250 between an outer sidewall 232 of the dome 228 and an inner sidewall 240 of a bowl 236. An outer surface 242 of the bowl 236 is also the outer surface 244 of the sealed blister package dome 245. In the middle state shown, the base sheet 224 has been lifted away from a portion of the sealing surface 252 of the sealing sheet 222. Once the base sheet 224 is peeled back, as shown to the far right of FIG. 4, contact lens 250 can be contacted with a fingertip and applied to the surface of an eye. Any contact lens packaging solution contained within the bowl drains out the bowl and away from the contact lens and the dome 228 onto the floor, or other surface, as the base sheet 224 is lifted away from the dome 228. As shown in FIG. 4, in a particular embodiment of the present disclosure, a blister package 220 for a contact lens is provided, wherein said blister package 220 comprises a base sheet 224 and a sealing sheet 222, both the base sheet 224 and sealing sheet 222 having first and second hemispherical ends, and wherein the base sheet 224 includes a bowl 236, and said sealing sheet 222 including a sealing surface 223 and a dome 228 that protrudes from the sealing surface 223, said dome providing a seat surface 232 for a contact lens 250, and said dome being configured such that when the blister package is sealed, the dome protrudes into the bowl 236 thereby forming a cavity between the dome 228 and the bowl 236. Additionally, both the base sheet 224 and sealing sheet 222 of said blister package include a circular through-hole 270, 280, wherein said circular through-holes align when the blister package is sealed to provide a single through-hole 260, which at least partially accommodates a dome of a second, separate, but substantially identical blister package.

Figure 5A:
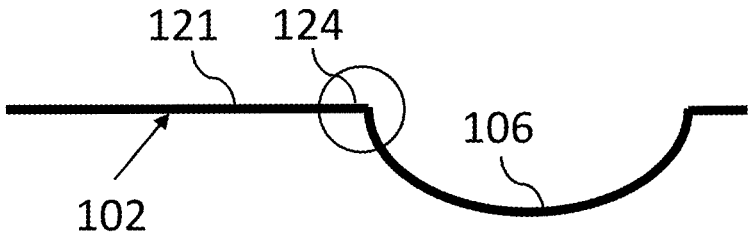
FIG. 5A illustrates a base sheet of the present blister packages.
Figure 5B:
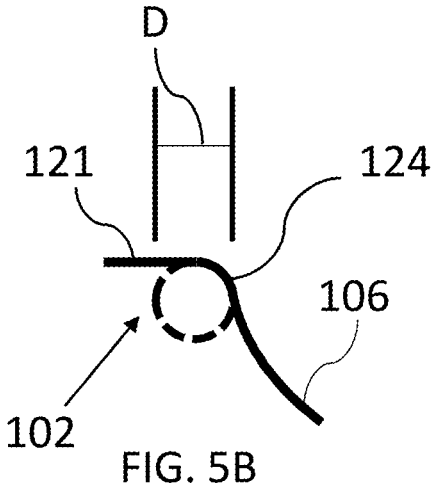
FIG. 5B is a magnified view of the circled region of FIG. 5A.

FIG. 5A illustrates a base sheet of the presently disclosed blister packages. A magnified view of the circled region of the base sheet is illustrated in FIG. 5B. FIG. 5B illustrates a base sheet 102 that has a planar surface 121, a bowl 106, and a transition surface 124 extending from the planar surface to the curved surface of the bowl. The transition surface 124 is shown as being a convexly curved surface having a radius of curvature. The radius of curvature corresponds to half the diameter D shown in FIG. 5B. The radius of curvature of the transition surface may be from 0.4 mm to 5.0 mm.

Various aspects of the present blister packages and methods will be understood from the following clauses:

§ 1. A blister package for a contact lens, the blister package comprising a base sheet and a sealing sheet, wherein: one of the base sheet and the sealing sheet includes a bowl, the other of the base sheet and the sealing sheet includes a sealing surface and a dome that protrudes from the sealing surface, the dome having a radius of curvature of about 13 mm to 19 mm and a height of less than 7 mm relative to the sealing surface, the dome protruding into the bowl, thereby forming a cavity between the dome and the bowl, the base sheet and the sealing sheet being releasably attached to each other, thereby releasably sealing the cavity.

§ 2. The blister package of clause 1, wherein the dome has a radius of curvature of 13 mm to 19 mm and a height of 1 mm to 7 mm relative to the sealing surface, preferably, the dome has a radius of curvature of 14.0 mm to 18.0 mm and a height of 3.5 mm to 4.5 mm relative to the sealing surface.

§ 3. The blister package of any one of clause 1 or 2, wherein the cavity has a volume of 2.0 mL or less, for example about 1.5 mL to 2.0 mL, 1.0 mL to 1.5 mL, 0.5 mL to 1.0 mL or 0.1 mL to 0.5 mL, preferably the cavity has a volume of 0.3 mL to 0.9 mL.

§ 4. The blister package of any one of the proceeding clauses, wherein the bowl has a radius of curvature that is less than the radius of curvature of the dome and a depth that is greater than the height of the dome, for example the bowl has a radius of curvature that is at least 5% less than the radius of curvature of the dome and a depth that is at least 5% greater than the height of the dome.

§ 5. The blister package of any one of the proceeding clauses, wherein the base sheet includes a flange portion that extends outwardly from the periphery of the bowl.

§ 6. The blister package of any one of the proceeding clauses, wherein the sealing sheet further comprises a pull-tab.

§ 7. The blister package of any one of the proceeding clauses, wherein the base sheet and the sealing sheet independently comprise a foil material.

§ 8. The blister package of any one of the proceeding clauses, wherein the cavity contains a contact lens, preferably an unworn contact lens.

§ 9. The blister package of clause 8, wherein the contact lens is orientated with its concave surface facing towards the dome.

§ 10. The blister package of clauses 8 or 9, wherein the cavity also contains a contact lens packaging solution.

§ 11. The blister package of clause 10, wherein the contact lens and contact lens packaging solution fill at least 60 percent of the total volume of the cavity formed between the bowl and the dome.

§ 12. The blister package of clause 10 or 11, wherein the contact lens and contact lens packaging solution are sealed within the cavity.

§ 3. The blister package of clause 12, wherein the contact lens and contact lens packaging solution are hermetically sealed within the cavity.

§ 14. A method of removing a contact lens from a blister package of any one of clauses 8 to 13, the method comprising peeling the sealing sheet away from the base sheet such that the dome and the contact lens are pulled away from the bowl.

§ 15. The method of clause 14, wherein the blister package is positioned such that as the sealing sheet is peeled away from the base sheet, the packaging solution is substantially contained within the bowl.

§ 16. The method of clauses 14 or 15, wherein the concave surface of the contact lens is reversibly adhered to the dome.

§ 17. The method of any one of clauses 14 to 16, wherein the contact lens is removed from the dome and placed on the surface of an eye.

§ 18. A method of removing a contact lens from a blister package, the method comprising peeling the sealing sheet away from the base sheet such that the dome and the contact lens are pulled away from the bowl.

Although the disclosure herein refers to certain example embodiments, those embodiments are presented by way of example and not by way of limitation. The intent of the foregoing detailed description, although discussing example embodiments, is to be construed to cover all modifications, alternatives, and equivalents of the embodiments as may fall within the scope of the invention as defined by the claims.

The invention claimed is:

1. A blister package for a contact lens, the blister package comprising a base sheet and a sealing sheet, wherein:

one of the base sheet and the sealing sheet includes a bowl, the other of the base sheet and the sealing sheet includes a sealing surface and a dome that protrudes from the sealing surface, the dome having a radius of curvature of 13 mm to 19 mm and a height of less than 7 mm relative to the sealing surface, the dome protruding into the bowl, thereby forming a cavity between the dome and the bowl, wherein the bowl has a radius of curvature that is 25% to 35% less than the radius of curvature of the dome, and a depth that is 35% to 45% greater than the height of the dome, the base sheet and the sealing sheet being releasably attached to each other, thereby releasably sealing the cavity, wherein the bowl contains a contact lens having a concave surface that faces towards the dome.

2. The blister package of claim 1, wherein the dome has a radius of curvature of 13 mm to 19 mm and a height of 1 mm to 7 mm relative to the sealing surface.

3. The blister package of claim 1, wherein the cavity has a volume of 2.0 mL or less.

4. The blister package of claim 1, wherein the bowl has a radius of curvature that is less than the radius of curvature of the dome and a depth that is greater than the height of the dome.

5. The blister package of claim 1, wherein the base sheet includes a flange portion that extends outwardly from the periphery of the bowl.

6. The blister package of claim 1, wherein the sealing sheet further comprises a pull-tab.

7. The blister package of claim 1, wherein the base sheet and the sealing sheet independently comprise a foil material.

8. The blister package of claim 1, wherein a contact lens packaging solution is also contained within the bowl.

9. The blister package of claim 8, wherein the contact lens and contact lens packaging solution fill at least 60 percent of the total volume of the cavity formed between the bowl and the dome.

10. The blister package of claim 8, wherein the contact lens and contact lens packaging solution are sealed within the cavity.

11. The blister package of claim 10, wherein the contact lens and contact lens packaging solution are hermetically sealed within the cavity.

12. The blister package of claim 1, wherein the dome has a radius of curvature from 14 mm to 18 mm, the bowl has a radius of curvature from 9 mm to 13 mm, and the base sheet has a transition surface extending radially outward from the bowl, the transition surface having a convex surface having a radius of curvature from 0.4 mm to 5.0 mm.

13. A method of removing a contact lens from a blister package according to claim 1, the method comprising peeling the sealing sheet away from the base sheet such that the dome and the contact lens are pulled away from the bowl.

14. The blister package of claim 1, wherein the height of the dome is 3.5 mm to 4.5 mm relative to the sealing surface.

* * * * *